US006403273B1

(12) United States Patent
Ting et al.

(10) Patent No.: US 6,403,273 B1
(45) Date of Patent: Jun. 11, 2002

(54) TONER PARTICULATES COMPRISING ALIPHATIC HYDROCARBON WAXES

(75) Inventors: Vincent Wen-Hwa Ting, Boulder; Michael Thomas Moore, Longmont, both of CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/781,034

(22) Filed: Feb. 9, 2001

(51) Int. Cl.[7] ..... G03G 9/08

(52) U.S. Cl. ..... 430/108.8; 430/109.3; 430/137.15; 430/108.4

(58) Field of Search ..... 430/137.15, 137.17, 430/108.8, 109.3, 108.4

(56) References Cited

U.S. PATENT DOCUMENTS

| | | | | |
|---|---|---|---|---|
| 5,077,168 A | | 12/1991 | Ogami et al. | |
| 5,176,978 A | | 1/1993 | Kumashiro et al. | |
| 5,264,311 A | | 11/1993 | Nakano et al. | |
| 5,292,609 A | | 3/1994 | Yoshikawa et al. | |
| 5,342,722 A | | 8/1994 | Ito et al. | |
| 5,547,801 A | | 8/1996 | Suzuki et al. | |
| 5,716,746 A | | 2/1998 | Mikuriya et al. | |
| 5,866,291 A | | 2/1999 | Ikegami et al. | |
| 5,935,751 A | * | 8/1999 | Matsuoka et al. | 430/108.8 |
| 5,948,583 A | * | 9/1999 | Silence et al. | 430/108.8 |
| 6,051,356 A | | 4/2000 | Nishihara et al. | |
| 6,057,076 A | * | 5/2000 | Berkes et al. | 430/108.8 |
| 6,120,961 A | * | 9/2000 | Tanikawa et al. | 430/108.8 |

OTHER PUBLICATIONS

Kirk–Othmer Concise Encyclopedia of Chemical Technology. New York: John Wiley & Sons. pp. 1259–1260. (1985).*

Grant, Roger et al. Chemical Dictionary. New York: McGraw–Hill, Inc. p. 290. (1987).*

* cited by examiner

*Primary Examiner*—Christopher Rodee
(74) *Attorney, Agent, or Firm*—John A. Brady

(57) ABSTRACT

Toner particulates comprise a styrene/acrylic copolymer having a first aliphatic hydrocarbon wax incorporated therein during polyermization of the copolymer, and a second aliphatic hydrocarbon wax mixed with the copolymer.

7 Claims, No Drawings

TONER PARTICULATES COMPRISING ALIPHATIC HYDROCARBON WAXES

FIELD OF THE INVENTION

This invention relates to toner particulates and toner compositions comprising particulates. More particularly, the invention relates to toner particulates comprising a styrene/acrylic copolymer having a first aliphatic hydrocarbon wax incorporated in the copolymer during polymerization, and a second aliphatic hydrocarbon wax mixed with the copolymer.

BACKGROUND OF THE INVENTION

Numerous methods and apparatus for electrophotography, electrostatic recording and electrostatic printing are known in the art. Typically, a charged photosensitive surface, for example, a charged photosensitive drum, is irradiated with an optical image and an electrostatic latent image is formed on the photosensitive surface. In the development process, a developing agent, i.e. toner, is added to the electrostatic latent image.

Typically, toner is fed to a developer roller by a metering blade positioned against the surface of the developing roller. The developing roller, with the toner on its surface, is typically rotated in a direction opposite to that of the photosensitive drum, and the toner adheres to the electrostatic latent image to develop the image.

Various toner compositions have been developed in order to provide improved copying, recording and/or printing with such apparatus. The toner may be applied as a dry powder or may be applied from a liquid. When applied from a liquid, the liquid portion does not transfer to the substrate in large amounts and solid toner particles carried by the liquid form a dry or damp powder image. To bind the toner image to the substrate, one or more steps are taken, known collectively as fixing the image. Although various ways of fixing are known, such as the application of solvent, fixing by heat is a predominant technique employed in current technology. Fixing by heat avoids the addition of new materials to the system, which are a separate expense and which must be kept out of the atmosphere or otherwise kept from being an environmental hazard to users.

However, heat fixing does not necessarily bind the powder firmly into the substrate and does not necessarily preserve the fixed image over time. It has been found that styrene/acrylic resin-based toners do not exhibit equivalent fuse grade, which is resistance to rubbing and scratching, of a polyester-based toner at low fusing temperatures. However, the polyester-based toner is more expensive than a styrene/acrylic resin-based toners.

Unfortunately, many less expensive toner compositions have unacceptable fuse grade, thereby decreasing the print quality of the printer. Accordingly, a need exists to develop toners with improved fuse grade at lower costs than polyester-based toners while maintaining good print quality.

SUMMARY OF THE INVENTION

Accordingly, it is the object of this invention to provide improved toner particulates and toner compositions.

One aspect of the present invention is a toner particulate. The toner particulate comprises a styrene/acrylic copolymer having a first aliphatic hydrocarbon wax incorporated therein during polymerization of the copolymer, and a second aliphatic hydrocarbon wax mixed with the copolymer.

Another aspect of the present invention is a toner particulate made by the process of incorporating a first aliphatic hydrocarbon wax during polymerization of a styrene/acrylic copolymer and mixing a second aliphatic hydrocarbon wax with the copolymer after polymerization of the copolymer.

The toner particulates may be manufactured at relatively low cost and exhibit good fuse grade. Still other objects, advantages and novel features of the present invention will become apparent to those skilled in the art from the following detailed description, which is simply by way of illustration, various modes contemplated for carrying out the invention. As will be realized, the invention is capable of other different obvious aspects, all without departing from the invention. Accordingly, the description is illustrative in nature and not restrictive.

DETAILED DESCRIPTION

The present invention relates to toner particulates and toner compositions comprising a styrene/acrylic copolymer having a first aliphatic hydrocarbon wax incorporated therein during polymerization of the copolymer, and a second aliphatic hydrocarbon wax mixed during the extrusion process with the copolymer.

The toner particulate comprises a styrene/acrylic polymer. As used herein, "styrene/acrylic polymer" refers to polymers formed from styrene monomer and acrylic monomer. Suitable acrylic monomers include, but are not limited to, acrylic acid, and acrylates thereof, for example, methyl acrylate, ethyl acrylate, butyl acrylate, dodecyl acrylate, octyl acrylate, 2-ethylhexyl acrylate, and phenyl acrylate, methacrylic acid, and methacrylates thereof, for example, methyl methacrylate, ethyl methacrylate, butyl methacrylate, and octyl methacrylate, acrylonitrile, methacrylonitrile, and acrylamide. Suitable styrene monomers include styrene, and substituted styrenes, including, but not limited to, alphamethyl styrene, parachlorosytrene, vinyl toluene and divinyl benzene.

Polymers typically exhibit a softening temperature and a flow temperature. As used herein, "softening temperature" is intended to refer to the temperature at which particle collapse begins, and "flow temperature" is intended to refer to the temperature at which the polymer achieves sufficient liquidity to be extruded in a capillary rheometer. The softening temperature and flow temperature can be determined using rheometers such as the SHIMADZU™ capillary rheometer.

The polymers for use in the toner particulates may include a cross-linking agent in an amount of from about 0.01 to about 5 parts by weight per 100 parts by weight of the monomers employed therein. Conventional cross-linking agents may be used. In one embodiment, the toner comprises a resin which is free of cross-linking agents.

Toner particulates may comprise more than one polymer. Generally, the polymers will have a glass transition temperature of no less than 55° C. In one embodiment, the particulate comprises a first polymer and a second polymer, each having a glass transition temperature of no less than about 55° C., preferably no less than about 60° C. Generally, the polymers will have molecular weights greater than about 2000.

In one embodiment, the toner particulate may comprise a first low molecular weight polymer and a second high molecular weight polymer.

The toner particulate further comprises a first aliphatic hydrocarbon wax, which is incorporated during the polymerization of the styrene/acrylic polymer. A second aliphatic hydrocarbon wax is mixed with the polymerized styrene/acrylic polymer containing the first aliphatic hydrocarbon wax after polymerization of the copolymer.

In one embodiment of the present invention, the first in-situ aliphatic hydrocarbon wax comprises a paraffin wax. In one exemplary embodiment, the paraffin wax has a melting point of from about 40° C. to about 130° C. More preferably, the paraffin wax has a melting point of from about 70° C. to about 120° C., and most preferably from about 80° C. to about 110° C. In another exemplary embodiment, the paraffin wax is of the formula $C_nH_{2n+2}$, wherein n ranges from about 12 to about 22, more preferably n is about 17.

In another embodiment of the present invention, the second external aliphatic hydrocarbon wax comprises a polyolefin wax. In one exemplary embodiment, the polyolefin wax has a melting point of from about 110° C. to about 140° C., more preferably from about 115° C. to about 125° C. In another exemplary embodiment, the polyolefin wax comprises polyethylene, polypropylene, a copolymer of an olefin and a styrene-malic anhydride half ester, or mixtures thereof.

In yet another embodiment of the present invention, the second aliphatic hydrocarbon wax comprises paraffin wax. In one exemplary embodiment, the paraffin wax is of the formula $C_nH_{2n+2}$, wherein n ranges from about 12 to about 22, more preferably n is about 17.

In another exemplary embodiment, the first aliphatic hydrocarbon wax has a molecular weight average range of from about 800 to about 1300 and a melting point of from about 70° C. to about 120° C. In another exemplary embodiment, the first aliphatic hydrocarbon wax has a wax domain as measured according to Scanning Electron Microscope (SEM) or Transmission Electron Microscope (TEM) of from about 0.1 micron to about 1.0 micron.

In one exemplary embodiment of the present invention, the second aliphatic hydrocarbon wax has a molecular weight average of from about 500 to about 4000. In still another exemplary embodiment, the second aliphatic hydrocarbon wax has a wax domain as measured according to SEM or TEM of from about 2 microns to about 5 microns.

In another embodiment of the present invention, the styrene/acrylic polymer has a bimodal molecular weight distribution comprising of at least 10% by weight, of polymer having a weight average molecular weight of from about 300,000 to about 1,000,000, and 90% or less by weight of polymer having a weight average molecular weight of about 40,000 or less.

In one embodiment of the present invention, the toner particulate comprises from about 0.5 to about 10 weight percent of, the first aliphatic hydrocarbon wax, and from about 1 to about 10 weight percent of the second aliphatic hydrocarbon wax. In another embodiment of the present invention, the styrene/acrylic copolymer and the first aliphatic hydrocarbon are combined in an amount of from about 90 to about 99 weight percent copolymer and from about 1 to about 10 weight percent of the first aliphatic hydrocarbon wax, based on the polymer and wax combined.

The toner composition may further comprise a magnetic component. Exemplary magnetic components may include magnetic pigments, metal oxides or mixtures thereof known in the art and typically employed in toner particulates. In one embodiment of the present invention, the toner particulate comprises iron oxide. Suitable iron oxides include magnetite, hematite, ferrite, and modified forms of such oxides. In one exemplary embodiment, the toner composition comprises, by weight, from about 5 to about 30 weight percent of the magnetic material.

The toner composition may further include one or more charge control agents which contribute to stabilization of the charge characteristics of the toner composition. In accordance with the present invention, the toner composition preferably is a negatively charged toner. Negatively-charged toner control agents include, but are not limited to, organic metal complexes or chelates of metals such as chromium, zinc, and/or iron, and aluminum complexes of an organic compound. Complexes or chelates of organic acids, azo compounds and the like are also suitable. In one embodiment of the present invention, the toner composition comprises an azo charge control agent, preferably a chromium azo charge control agent.

In one exemplary embodiment, the charge control agent is included in the toner composition in an amount sufficient to contribute to stabilization of the charge characteristics. In one embodiment of the present invention, the toner composition comprises, by weight, from about 0.1 to about 10%, preferably from about 0.25 to about 5%, more preferably from about 0.5 to about 2% and still more preferably about 1.5% of a charge control agent.

The toner particulates of the present invention are typically prepared as follows: the first aliphatic hydrocarbon wax is incorporated into the styrene/acrylic copolymer during polymerization of the styrene/acrylic copolymer. The second aliphatic hydrocarbon wax may thereafter be kneaded with the styrene/acrylic polymer containing the first aliphatic hydrocarbon wax. The resultant mixture is, for example, solidified, pulverized and temporarily classified to provide toner particulates of a desired size. Kneading may be performed with a heat-kneading machine such as a heat roller, a kneader or an extruder. Milling or pulverizing may be performed with any suitable crushing or grinding mill.

Typically toner particulates have a diameter in the range of from about 1 to about 50 microns, and more preferably in the range of from about 1 to about 25 microns, and still more preferably from about 6 to about 12 microns. A preferred particle size distribution is one wherein the median particle diameter size is the range of from about 6 microns to about 12 microns, more preferably in the range of from about 7 microns to about 11 microns.

As mentioned above, the first aliphatic hydrocarbon wax is incorporated into the styrene/acrylic copolymer during polymerization of the styrene/acrylic copolymer resin. In one embodiment, after polymerization, additional toner particulate ingredients may be mixed, sifted into an extruder and melt mixed with the polymer containing the first wax. The mixture coming out of the extruder may be solidified, for example, using an underwater pelletizer or chilled roller. The mixture may then be milled, for example, in an air jet mill, and classified to obtain toner particulates of the desired size.

The milled and classified toner particulates may be blended in a high speed blender with silicas, inorganic oxides and/or inorganic compounds. Suitable silicas include fumed silica and hydrophobically treated fumed silica. Preferably, the silica is a hydrophobically treated fumed silica. In one embodiment of the present invention, the resulting toner composition comprises the toner particulates with silica, inorganic oxides associated on the surface thereof and/or which may be present in the toner particulate surface.

In another embodiment of the present invention, the toner particulates are blended with silica, preferably hydrophobically treated fumed silica, and inorganic compounds. The toner particulates may be blended with from about 1.0% to about 1.2%, preferably about 1%, silica and from about 0.1% to about 3.0%, preferably 1%, inorganic compounds, by weight of the total toner composition.

In one embodiment, the toner composition comprises from about 40 to about 95 weight percent of the toner particulate. In another exemplary embodiment, the toner composition comprises from about 60 weight percent to about 85 weight percent of the toner particulate.

Typically, toner compositions comprising toner particulates in accordance with the invention are applied to substrates such as paper. In one embodiment, after application to the paper, the toner composition is heated and pressed. A fuser assembly having at least one rotating heat roller and at least one rotating pressure roller may be used for heating and pressing. The heat roller and pressure roller may be arranged in opposition to each other to form a nip. The paper is passed through the nip. Heat and pressure are applied as the paper passes through the rotating head and pressure rollers.

Generally heat is applied in the temperature range of at least of about 100° C., more preferably from about 100° C. to about 250° C., even more preferably from about 140° C. to about 190° C., and most preferably from about 160° C. to about 180° C. In one exemplary embodiment, pressure may be applied in an amount of at least about 10 pounds per square inch, preferably from about 10 to about 30 pounds per square inch.

Toner particulates according to the present invention will be further illustrated in the following examples. Throughout the examples and the present specification, parts and percentages are by weight unless otherwise specified.

EXAMPLE 1

This example is directed to toner particulates and toner compositions of the present invention which use a first aliphatic hydrocarbon wax in-situ of the styrene/acrylic copolymer, i.e., added to the copolymer during polymerization of the copolymer. Toner compositions are formulated, respectively, using conventional toner particulates and toner particulates of the present invention comprising the first aliphatic hydrocarbon wax incorporated during the polymerization of the copolymer (in-situ) and the second aliphatic hydrocarbon wax mixed with the styrene/acrylic copolymer. The styrene/acrylic copolymers employed in this example comprised Sekisui H-1285, H-1313, and H-1314 as set forth in Table 1, while a K5 polyester resin from Kao was employed for comparison purposes. Table 1 summarizes the Sekisui resins utilized in this example.

TABLE 1

| | First In-Situ Wax | |
|---|---|---|
| Resin ID | Wax Type | Weight Percent Wax |
| H-1313 | None | 0 |
| H-1314 | Paraffin 76° MP | 4 |
| H-1285 | Paraffin 76° MP | 5 |
| Kao K5 Polyester | None | 0 |

As will be apparent from Table 2, toner compositions 1A–1D, 1F and 1H are comparative toner compositions whereas toner compositions 1E and 1G were prepared using toner particulates according to the present invention. The additives shown in Table 2 are ordinary toner additives known to one skilled in the art.

TABLE 2

| Toner ID | Resin ID | Auxiliary Wax Type | Weight Percent Wax |
|---|---|---|---|
| 1A* | H-1313 | Polyethylene mw~2000 | 1 |
| 1B* | H-1313 | Polyethylene mw~500 | 1 |
| | | Polyolefin-maleic anhydride mw~700 | 1.5 |
| 1C* | H-1313 | Polyethylene mw~500 | 1 |
| | | Polyolefin-maleic anhydride mw-700 | 5 |
| 1D* | H-1314 | None | 0 |
| 1E | H-1314 | Polyethylene mw~2000 | 1 |
| IF* | H-1285 | None | 0 |
| 1G | H-1285 | Polyethylene mw~2000 | 1 |
| 1H* | Kao K5 | Polyethylene mw~500 | 1 |
| | Polyester | Polyolefin-maleic anhydride mw-700 | 1.5 |

*Comparative toner compositions
All weight percent based on weight of toner composition Each toner composition was used to print 24# Strathmore cotton bond paper using a modified Lexmark Optra T printer, employing a fuse temperature of 190° C. For each toner composition, various fuse grade measurements are performed. These fuse grade measurements include a mechanical rubbing device, character fingernail scratch test and an all black rubbing test. For the mechanical rub test, two pel vertical lines were printed on 24# Strathmore cotton bond paper. Cloth material was inserted into a weighted holder and the cloth was rubbed across the lines ten times. The cloth was removed and optical density was taken of the area that came in contact with the toner in the vertical lines. For the Character Fingernail Scratch Test, a printed sample of text (characters) is used. Rest the arm on a table containing the printed text. Using the index finger only while the hand is suspended above the text and gently rub characters with index finger fingernail. If the character is blurred easily, a low rating is assigned. Increasing the pressure of the fingernail will correspond to an increase in the rating. The highest rating would require maximum pressure without any distortion of the character. The all black test: from an all black page, printed on 24# Strathmore cotton bond paper, cut a strip ¾ inch by 2 ½ inch and rub a paper towel (K-dry) from left to right twenty times. The amount of toner removed is estimated in percentage of the original sample.

TABLE 3

| Toner ID | Average Mech. Rub Test Fuesgrade (lower is better) | Average Fingernail Character Fusegrade (8 is best, 1 is poor) | Average All Black Rub Fusegrade (Lower is better) |
|---|---|---|---|
| 1A* | 0.75 | 5.5 | 40 |
| 1B* | 0.83 | 4.5 | 40 |
| 1C* | 0.45 | 6 | 20 |
| 1D* | 0.77 | 5 | 30 |
| 1E | 0.43 | 6 | 15 |
| 1F* | 0.62 | 5 | 28 |
| 1G | 0.27 | 7 | 5 |
| 1H* | 0.34 | 5.6 | 15 |

*Comparative toner compositions

The results set forth in Table 3 demonstrate that toner compositions 1E and 1G exhibit improved fuse grade over the comparative toner compositions 1A–1D, 1F and 1H. In particular, toner composition 1G exhibits superior Rub-O-Meter fuse grade, average character fuse grade and all average black rub fuse grade over the comparative toner compositions. The improvements exhibited by toner compositions 1G are surprising since comparative toner composition 1F comprised the same H-1285 resin but without the incorporation of the auxiliary paraffin wax, yet toner compositions 1G yielded improved fuse grades over the comparative toner compositions 1F. It is surprising that a toner composition comprising the styrene/acrylic copolymer having a first aliphatic hydrocarbon wax incorporated during polymerization of the copolymer and a second a second aliphatic hydrocarbon wax mixed with the copolymer provides a toner composition with improved fuse grade over conventional toner compositions.

EXAMPLE 2

In this example, additional toner compositions 2A–2F were prepared comprising a styrene/acrylic copolymer having a first aliphatic hydrocarbon wax incorporated therein during polymerization of the copolymer and a second aliphatic hydrocarbon wax mixed with the copolymer. In each of the toner compositions 2A–2F, the first aliphatic hydrocarbon wax comprised a paraffin wax incorporated at a level of 5% by weight of the toner particulate. As can be noted from Table 4, the second aliphatic hydrocarbon wax comprised either a polyethylene wax, a polypropylene wax, a styrene-maleic anhydride half ester copolymer wax, or a paraffin wax. Each toner composition was prepared using the general procedures described in Example 1.

As in Example 1, each toner composition comprised 11% iron oxide, 4% carbon black, 1% silica, 2.5% charge control agent, and about 1.4% post blending additives.

TABLE 4

| | Polymer | In-Situ | | Auxiliary | |
|---|---|---|---|---|---|
| Toner ID | ID | Wax Type | % Wax | Wax Type | % Wax |
| 2 A | H-1285 | Paraffin 76° MP | 5 | Polyethylene mw~2000 | 1 |
| 2 B | H-1285 | Paraffin 76° MP | 5 | Paraffin 76° MP | 1 |
| 2 C | H-1285 | Paraffin 76° MP | 5 | Paraffin 76° MP | 5 |
| 2 D | H-1285 | Paraffin 76° MP | 5 | Polyolefin-maleic anhydride mw-700 | 1 |
| 2E | H-1285 | Paraffin 76° MP | 5 | Polyolefin-maleic anhydride mw-700 | 5 |
| 2 F | H-1285 | Paraffin 76° MP | 5 | Polypropylene mw~4000 | 1 |

The toner compositions of this example were subjected to measurements of mechanical rub tester, character fingernail scratch test, and all black fuse grade according to the procedures described in example 1. The results of these measurements are set forth in Table 5.

TABLE 5

| Toner ID | Average Mech. Rub Test Fuesgrade (lower is better) | Average Fingernail Character Fusegrade (8 is best, 1 is poor) | Average All Black Rub Fusegrade (Lower is better) |
|---|---|---|---|
| 2 A | 0.28 | 7.5 | 6 |
| 2 B | 0.23 | 6.5 | 10 |
| 2 C | 0.14 | 7.5 | 3 |
| 2 D | 0.28 | 6.5 | 5 |
| 2E | 0.15 | 7.5 | 7 |
| 2 F | 0.29 | 6.5 | 5 |

As set forth in Table 5, the toner composition 2C comprising a styrene/acrylic copolymer having 5% paraffin wax incorporated therein during polymerization of the copolymer, and 5% second paraffin wax, both percentages based on the toner particulate, exhibited superior fuse grade performance. Toner composition 2C exhibited superior mechanical rub test fuse grade, character fingernail scratch test and all black fuse grade over other toner compositions of the present invention.

EXAMPLE 3

In this example, additional toner compositions 3A–3D, according to the present invention, were prepared using the general procedures described in Example 1. The styrene/acrylic copolymer the respective toner compositions comprises Sekisui H-1285 toner pellet having a paraffin wax incorporated during the polymerization of the styrene/acrylic copolymer. The paraffin wax is incorporated at a 5% by weight level of the toner particulate. The second aliphatic hydrocarbon wax mixed with the styrene/acrylic copolymer and first aliphatic hydrocarbon wax comprised a polyethylene wax and is used at varying concentrations of from 1 to 6 weight percent of the toner particulate. Table 6 sets forth the various toner compositions formulations. As in Example 1, each toner composition comprised 11% iron oxide, 4% carbon black, 1% silica, 2.5% charge control agent, and 1.4% post blending additives.

TABLE 6

| | Polymer | In-Situ | | Auxiliary | |
|---|---|---|---|---|---|
| Toner ID | ID | Wax Type | % Wax | Wax Type | % Wax |
| 3 A | H-1285 | Paraffin 76° MP | 5 | Polyethylene mw~2000 | 1 |
| 3 B | H-1285 | Paraffin 76° MP | 5 | Polyethylene mw~2000 | 2 |
| 3 C | H-1285 | Paraffin 76° MP | 5 | Polyethylene mw~2000 | 4 |
| 3 D | H-1285 | Paraffin 76° MP | 5 | Polyethylene mw~2000 | 6 |

The toner compositions of this example were subjected to mechanical rub tester fuse grade, character fuse grade, and average black fuse grade as described in Example 1. Results of these measurements are set forth in Table 7.

TABLE 7

| Toner ID | Average Mech. Rub Test Fuesgrade (lower is better) | Average Fingernail Character Fusegrade (8 is best, 1 is poor) | Average All Black Rub Fusegrade (Lower is better) |
|---|---|---|---|
| 3 A | 0.32 | 7.0 | 6 |
| 3 B | 0.17 | 7.5 | 7 |
| 3 C | 0.16 | 7.5 | 5 |
| 3 D | 0.15 | 7.5 | 3 |

From the results set forth in Table 7, one of ordinary skill in the art will recognize that the toner compositions 3B, 3C and 3D exhibit significantly improved fuse grade in comparison to toner composition 3A of the present invention.

Thus, these examples demonstrate that the toner compositions according to the present invention exhibit improved fuse grade as compared against conventional toner compositions.

The various preferred embodiments and examples set forth herein are presented in order to further illustrate the claimed invention and are not intended to be limiting thereof. Additional embodiments and alternatives within the scope of the claimed invention will be apparent to those of ordinary skill in the art.

We claim:

1. A toner particulate comprising:

(a) a styrene/acrylic copolymer having a paraffin wax having a melting point of about 75° C. incorporated therein during polymerization of the copolymer in amount of about 5% by weight of said toner particulate; and (b) a paraffin wax having a melting point of about 75° C. mixed with the copolymer in amount of about 5% by weight of said toner particulate.

2. The toner particulate of claim 1, wherein the incorporated wax has a wax domain in the copolymer of from about 0.1 micron to about 1.0 micron.

3. The toner particulate of claim 2, wherein the mixed wax has a wax domain of from about 2 microns to about 5 microns.

4. The toner particulate of claim 1, wherein the mixed wax has a wax domain of from about 2 microns to about 5 microns.

5. The toner particulate of claim 1, wherein the styrene/acrylic copolymer has a bi-modal molecular weight distribution comprising at least 10% by weight copolymer having a weight average molecular weight of from about 300,000 to about 1,000,000 and 90% or less by weight copolymer having a weight average molecular weight of about 40,000 or less.

6. A toner composition comprising: from about 40 to about 80 weight percent of the toner particulate of claim 1; and from about 5 to about 30 weight percent of a magnetic material, based on the toner particulate.

7. The toner composition of claim 6, further comprising from about 1 to about 5 weight percent of a charge control agent, based on the toner composition.

* * * * *